United States Patent [19]

Rupp et al.

[11] 4,316,065

[45] Feb. 16, 1982

[54] PLUNGER SWITCH

[75] Inventors: Gerhard H. Rupp; Hans F. Schneider, both of Radolfzell, Fed. Rep. of Germany

[73] Assignee: TRW Inc., Cleveland, Ohio

[21] Appl. No.: 92,882

[22] Filed: Nov. 9, 1979

[30] Foreign Application Priority Data

Nov. 10, 1978 [DE] Fed. Rep. of Germany ..... 2848875

[51] Int. Cl.[3] ..... H01H 3/14

[52] U.S. Cl. ..... 200/61.89; 200/16 B

[58] Field of Search ..... 200/16 A, 16 B, 16 C, 200/16 D, 16 F, 61.89, 159 R, 340

[56] References Cited

U.S. PATENT DOCUMENTS

| | | | |
|---|---|---|---|
| 2,432,682 | 12/1947 | Robson | 200/61.89 |
| 2,716,678 | 8/1955 | Randol | 200/61.89 |
| 3,710,048 | 1/1973 | Schumacher | 200/61.89 X |
| 4,137,440 | 1/1979 | Bryant | 200/61.89 X |

*Primary Examiner*—Gene Z. Rubinson

*Attorney, Agent, or Firm*—James R. O'Connor

[57] ABSTRACT

An automobile brake light switch has a switch housing, a spring-loaded plunger extending through the housing, fixed terminals mounted in the housing, a slide coupled to the plunger, and a resilient movable contact mounted on the slide to engage the terminals. The slide is coupled to the plunger so that it will travel reciprocally and linearly relative to the housing upon operation of the plunger. The plunger is linearly adjustable relative to and independently of any movement of the slide.

10 Claims, 14 Drawing Figures

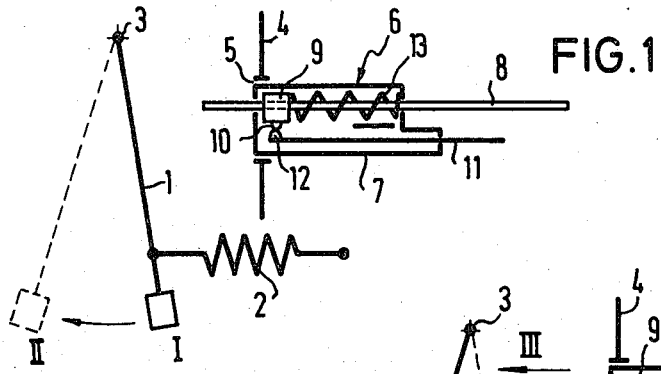
FIG.1
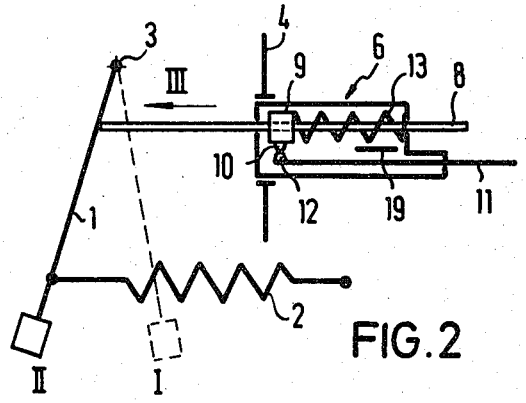
FIG.2
FIG.3
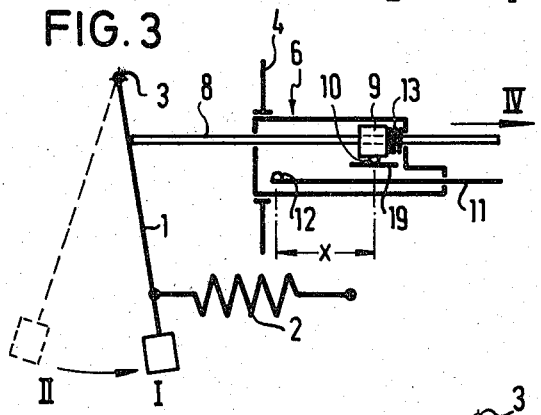
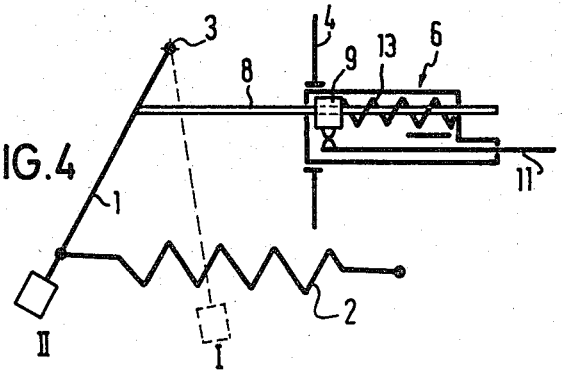
FIG.4

FIG.8
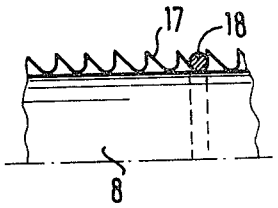
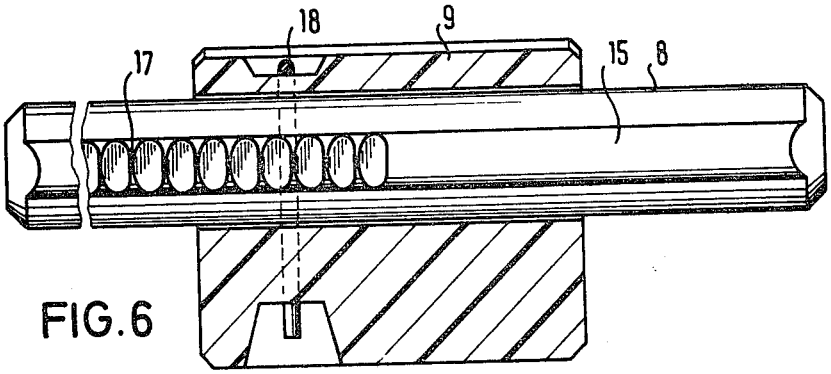
FIG.6
FIG.7
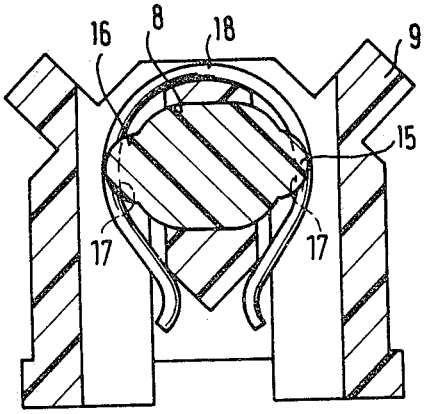

PLUNGER SWITCH

BACKGROUND OF THE INVENTION

The invention relates to a plunger switch, especially a brake light switch, with a plunger disposed inside a housing, with electrical terminals, with a contact part between the plunger and the electrical terminals, and with a switch adjustment.

Mechanical brake light switches are already known as the state of the art, said switches having to be adjusted by automobile plants and by garages by using devices or by feel. There are already switches which are self-adjusting as they are installed. The function can be acomplished either by nuts or lever connections or latching elements. However, the cost of these known switches is considerable.

An additional disadvantage of known plunger switches consists in the fact that, for example when they are used as brake light switches, the wear of the brake linings and/or evaporation of the brake fluid causes the brake pedal travel to vary as a function of time. As a result, the switch may no longer function properly, a situation which can result in failure of the switch and/or failure of the brake lights to be illuminated.

On the other hand, the goal of the present invention is to provide a plunger switch, especially a brake light switch, of the type recited hereinabove, said switch having a simple design and a provision for easy, and in certain embodiments automatic, adjustment.

This goal is achieved according to the invention by virtue of the fact that the contact part is connected to a moving element and the moving element is coupled to the plunger such that the element will travel reciprocally and linearly with the plunger, but the plunger is linearly adjustable relative to and independently of any movement of the moving element. This offers the advantage that the plunger switch according to the invention is easily, and in certain embodiments automatically, adjustable in the housing. The result is much smaller switch which requires less space for installation. The switch according to the invention can be mounted either directly on the brake pedal (suspended or upright brake pedal) or somewhere on the system of levers connecting the brake pedal and the brake cylinder. The fact that the contact part is movable together with the moving element in two directions together with the plunger and the fact that the plunger is independently adjustable relative to the moving element provide the solution to the above-mentioned problem.

SUMMARY OF THE INVENTION

In a preferred embodiment of the invention, the moving element is a reciprocating slide on which the contact part in the form of a crossbar contact is mounted. The slide is spring-loaded and guided in the housing and comprises a through-opening for the plunger which projects outwardly from both ends of the housing. The plunger and slide are connected together by a ratchet and pawl arrangement. This achieves the above-mentioned effect, namely that the slide is movable reciprocally and linearly together with the plunger and the plunger is adjustable relative to and independently of the slide.

In the preferred embodiment of the invention, the plunger includes a ratchet into which a detent spring (the pawl) mounted on the slide engages.

In another embodiment of the invention, the plunger, which has an oval cross section, carries a ratchet on each of its narrow, external sides into which the U-shaped detent spring (the pawl) engages.

In another embodiment the plunger, which has an oval cross section, has an elongated hole formed therein and the sides of the plunger defining the hole carry a ratchet into which the U-shaped detent spring (the pawl) engages.

In another embodiment of the invention, the plunger, which has an oval cross section, carries a ratchet on each of its external narrow sides into which matching teeth (the pawl) on the slide engage.

According to another embodiment of the invention, the plunger is provided with at least one spring-loaded pawl which engages a ratchet disposed on the slide.

According to still another embodiment of the invention, the plunger is provided with at least one spring-loaded locking ball (the pawl) which engages a ratchet disposed on the slide.

BREIF DESCRIPTION OF THE DRAWING

FIG. 1 is a schematic representation of a switch according to the invention with a cooperating brake pedal;

FIG. 2 is a schematic representation similar to FIG. 1, cooperating between the brake pedal and the brake light switch;

FIG. 3 shows the brake light switch and the brake pedal in the end position as installed;

FIG. 4 shows the brake light switch and the brake pedal after te brake linings have become worn;

FIG. 6 shows the slide and plunger of the brake light switch according to FIG. 5;

FIG. 7 is a cross section through the center of the elements shown in FIG. 6;

FIG. 8 shows the ratchet on the plunger shown in FIGS. 6 and 7;

DETAILED DESCRIPTION OF THE ILLUSTRATIVE EMBODIMENTS

Figure 5:
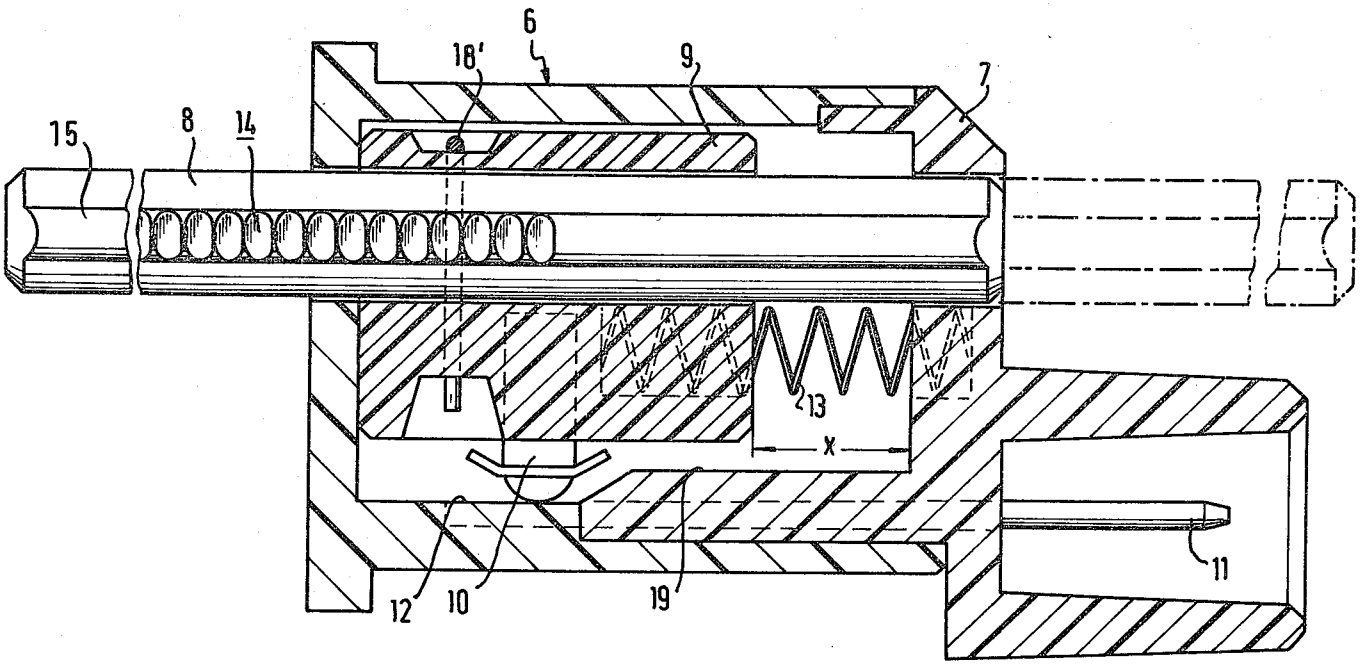
FIG. 5 is a side view of the brake light switch according to the invention in cross section.

FIGS. 1 to 4 are a schematic representation of the interraction between the brake light switch and the brake pedal. In FIG. 1, a suspended brake pedal 1 is mounted at pivot 3 and is held in the released position by a spring 2. When brake pedal 1 is operated, it is free to pivot about pivot 3 from position I to position II. The vehicle additionally comprises a frame part 4, provided with an opening 5 to accept brake light switch 6 according to the invention. This brake light switch 6 consists of a housing 7, a plunger 8 disposed inside the housing and projecting therefrom at both ends, a slide 9, a spring-loaded U-shaped contact element 10 and electrical terminals 11 with a contact 12.

Brake light switch 6 is delivered to the automobile plant in question, for example in the position shown in FIG. 1, and is installed in opening 5 in frame part 4. Initially, there is no effective link between the front of plunger 8 and brake pedal 1. In FIG. 2, the plunger 8 is shown displaced in the direction of arrow III, so that there is now a working connection between brake pedal 1 in the applied position and the brake light switch according to the invention, whereby contacts 10 and 12 are closed and a brake light connected to the switch is energized.

If, as shown in FIG. 3, brake pedal 1 now swings back from position II to position I under the influence of spring 2, brake pedal 1 slides plunger 8 in the direction of arrow IV whereby the movable contact 10 disposed on slide 9 rides up on ramp 19 and separates from contact 12 of the terminal 11 and the connection to a brake light is broken. This produces a reliable operating connection between brake pedal 1 and brake light switch 6 according to the invention. Each time pedal 1 is actuated and swung from position I to position II, spring 12, disposed in the housing of brake light switch 6 pushes slide 9 and movable contact 10 as well as plunger 8 as shown in FIG. 2 in the direction of arrow III, once again producing a contact between parts 10 and 12 as shown in FIG. 2.

Therefore, while slide 9 can travel for only a distance equal to x (FIG. 3) within the housing of brake light switch 6, plunger 8 can be readily indexed relative to the slide to effect switch adjustment which in certain embodiments and situations is automatic.

After brake light switch 6 has been installed, brake pedal 1 is depressed fully, whereby slide 9 travels a limited distance x, while plunger 8 can be displaced up to the stop of the brake pedal. When brake pedal 1 returns, slide 9 travels distance x once again in the opposite direction thereby opening the switch contacts.

If the brake linings should wear, resulting in a situation in which brake pedal 1 must move a greater distance, as shown in FIG. 4, the position of plunger 8 can be manually adjusted, i.e., indexed, relative to slide 9 and brought back into contact with brake pedal 1.

FIG. 5 depicts a preferred embodiment of the brake light switch 6 according to the invention. This switch 6 has a housing 7 in which plunger 8 and slide 9 are disposed. Slide 9 carries a crossbar contact 10 which is spring biased downwardly into contact with the terminals 11 by springs (not shown) which are seated in the slide and the switch is closed. Housing 9 is biased to the left end of housing 7 as viewed in the drawing by a spring 13 to hold the switch in the closed position.

As shown in FIGS. 5, 6, 7, and 8, plunger 8 is made oval in cross section and is provided with a ratchet 17 on each of its narrow sides 15 and 16. A detent spring 18 engages ratchet 17, thereby making it possible to move plunger 8 linearly and reciprocally together with slide 9 and to deliberately adjust plunger 8 relative to slide 9. Rachet 17 and spring 18 (the pawl) prevent accidental movement of the plunger 8 relative to slide 9.

FIG. 5 shows that the above-mentioned design makes it possible for slide 9 to travel a limited distance x in the housing while plunger 8 can be indexed further outwardly of the housing 7 until it strikes the brake pedal stop. When the brake pedal returns, slide 9 again travels distance x in the opposite direction. When crossbar contact 10 is raised upwardly by the ramp, the switch is opened and a brake light connected to the switch is deenergized.

Figure 9:
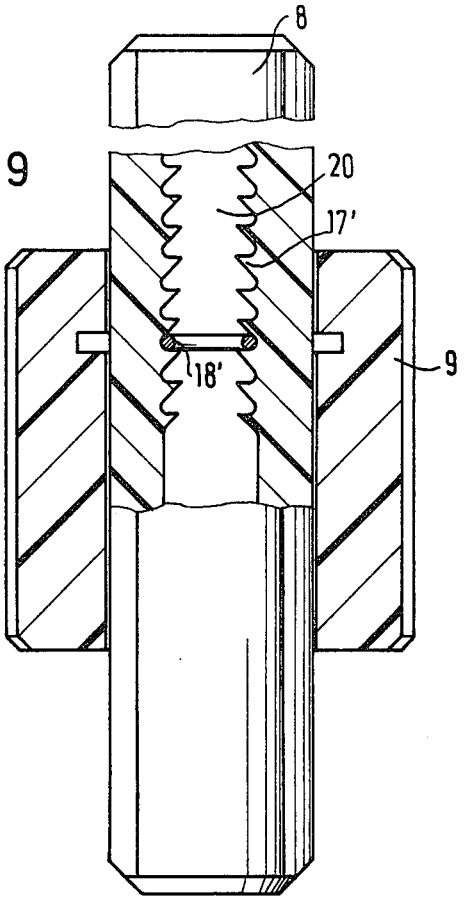
FIG. 9 shows another embodiment of the slide and the plunger, partially sectioned and cut away.
Figure 10:
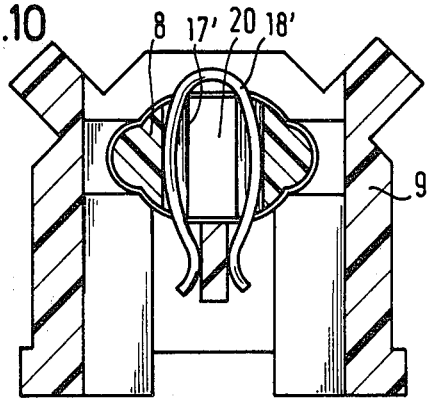
FIG. 10 is a cross section through the center of the plunger and slide shown in FIG. 9.

In the embodiment depicted in FIGS. 9 and 10, the plunger 8 is provided with an elongated hole 20 and the internal sides of the plunger defining the hole carries a ratchet 17'. Ratchet 17' cooperates with detent spring 18' to couple slide 9 to plunger 8.

Figure 11:
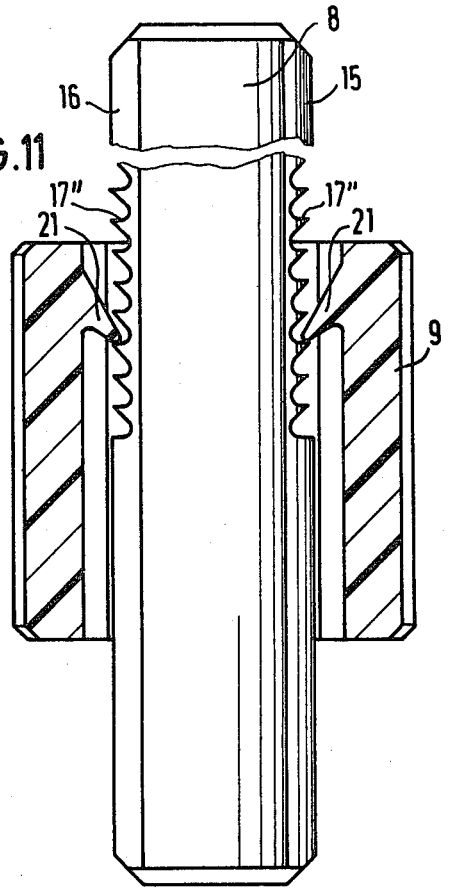
FIG. 11 is another embodiment of the slide and plunger shown in a central cross section.
Figure 12:
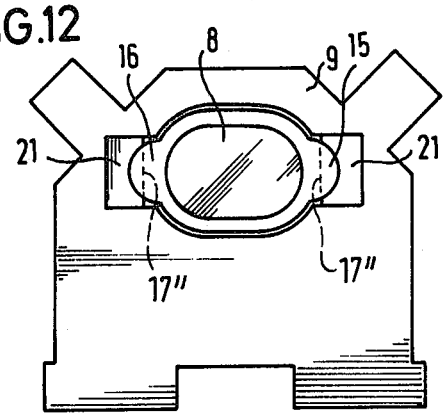
FIG. 12 is a cross section through the slide and plunger shown in FIG. 11.

In the embodiment shown in FIGS. 11 and 12, plunger 8, with an oval cross section, is provided with a ratchet 17'' on each of its external narrow sides 15 and 16. Ratchet 17'' cooperates with a matching tooth 21 provided on slide 9 to couple the slide to the plunger.

Figure 13:
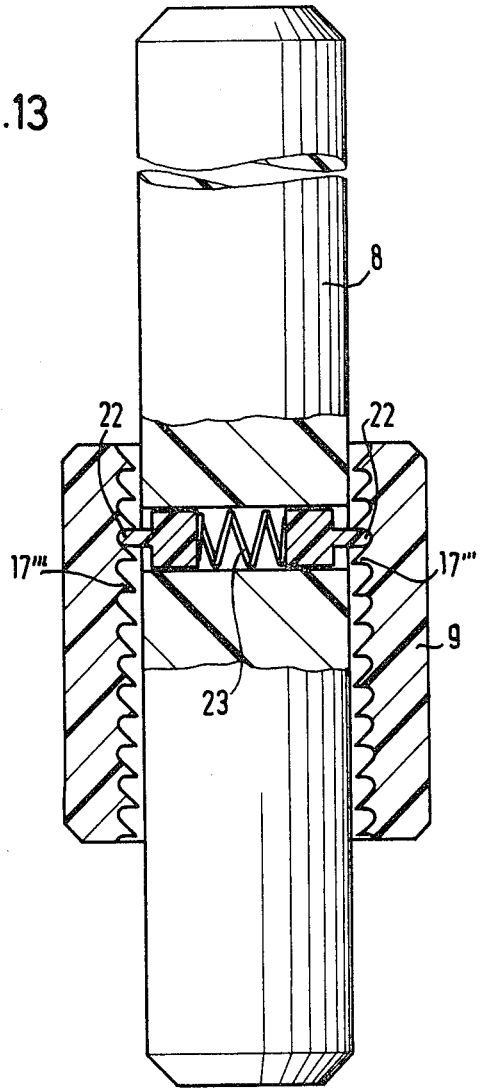
FIG. 13 is another embodiment of the slide and plunger.
Figure 14:
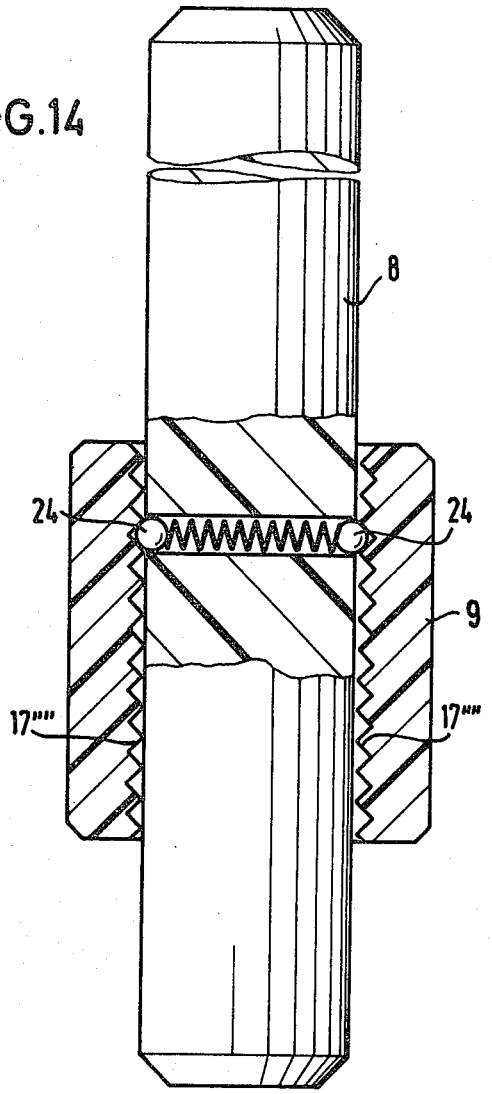
FIG. 14 is another embodiment of the slide and plunger.

In the embodiment shown in FIG. 13, the plunger carries two pawls 22 biased outwardly of the plunger by a spring 23 to engage ratchet teeth 17'' formed on the inside walls of slide 9.

In the embodiment of FIG. 13, two spring-loaded balls 24 carried by the plunger engage ratchet 17'''' disposed on the inside walls of slide 9. This particular embodiment is particularly advantageous in rendering the switch automatically adjustable. For example, having reference again to FIGS. 1 through 4, if the switch 6 were installed in the support 4 with the plunger 8 extending substantially out of the switch housing to the left as shown in FIG. 4, but the brake linings were not worn so that the brake pedal would travel only the distance from I to II and back as shown in FIGS. 1, 2 and 3, then the force of the brake pedal engaging the plunger 8 would in most instances be sufficient to overcome the ratchet and pawl coupling of this embodiment so that the plunger 8 would in effect be automatically indexed relative to the slide and to the right as depicted in the drawing until it assumed a proper position relative to the housing which would be the position of relative adjustment shown in FIG. 3. Thus, as aforesaid, the switch is in certain embodiments and situations automatically adjustabe and it is envisioned that other forms of pawls and ratchets including modified forms of the other embodiments described above could be employed to provide the switch with this automatic adjustment capability.

A switch according to the invention, depending on its function, can be delivered with normally open or normally closed contacts. In addition, the switch can be mounted either directly on the brake pedal (suspended or vertical brake pedal) or on a lever system connecting the brake pedal and the brake cylinder. In addition, there is the further possibility of not screwing the switch into place but fastening it in a holder 4 with clips, resulting in a saving of time and money during assembly.

It is of course possible to have two electrical terminals 11 in slide 9 on opposite sides of ramp 19. It is also possible, instead of using the spring-loaded crossbar contact 10, to make the latter from resilient springy metal in the form of a U. Embodiments having flat springs, contact rollers, rolls, or balls are also possible. When terminals 11 are located on both sides of ramp 19, the U-shaped crossbar contact 10 must have a symmetrical shape.

What is claimed as new and desired to be secured by Letters Patent of the United States is:

1. A plunger switch which is particularly adaptable for use as an automotive vehicle brake light switch comprising a switch housing, a plunger partially disposed both inside and outside the housing, said plunger carrying one of a pawl and a ratchet, electrical terminals mounted in the housing, a movable element mounted on the plunger, said movable element carrying one of a pawl and a ratchet, and a switch contact part mounted on the movable element and engageable with the terminals, said pawl and ratchet being in engagement with one another to couple the movable element to the plunger so that the element travels reciprocally and linearly relative to the housing responsive to depression and release of the plunger and the plunger is linearly adjustable relative to and independently of any movement of the movable element.

2. A plunger switch according to claim 1 wherein the movable element is a reciprocating slide.

3. A plunger switch according to claim 2 wherein the switch contact part is in the form of a crossbsr fixed to the slide through a spring-loaded mounting.

4. A plunger switch according to claim 2 wherein the ratchet is carried by the plunger and the pawl is in the form of a metal detent spring carried by the slide.

5. A plunger switch according to claim 4 wherein the plunger has an oval cross section and the ratchet is carried by the plunger and is in the form of teeth extending along the narrower side of the plunger.

6. A plunger switch according to claim 4 wherein the plunger has an elongated oval shaped hole formed therein and the ratchet is formed on the inside, longer side walls of the plunger defining the opening.

7. A plunger switch according to claim 2 wherein the plunger is of oval cross section and the ratchet is in the form of teeth formed on the external narrower sides of the plunger and the pawl is in the form of matching teeth formed on and extending from the inside walls of the slide defining the opening through which the plunger extends.

8. A plunger switch according to claim 2 wherein the slide is spring loaded in the housing, has an opening through which the plunger extends, and the plunger projects outwardly from both ends of the housing.

9. A plunger switch according to claim 2 wherein the plunger carries a spring-loaded pawl and the slide is formed with a ratchet extending along its inside walls defining the opening therein through which the plunger extends.

10. A plunger switch according to claim 2 wherein the pawl is a spring-loaded locking ball carried by the plunger and the ratchet is in the form of a series of recesses formed in the inside walls of the slide defining the opening therein through which the plunger extends.

* * * * *